United States Patent [19]

Brown

[11] 4,379,653

[45] Apr. 12, 1983

[54] ASPHALT PAVER WITH TELESCOPING SCREED

[75] Inventor: Robert L. Brown, Mattoon, Ill.

[73] Assignee: White Consolidated Industries, Inc., Cleveland, Ohio

[21] Appl. No.: 269,383

[22] Filed: Jun. 1, 1981

[51] Int. Cl.[3] ..... E01C 19/22

[52] U.S. Cl. ..... 404/118; 404/104; 404/95

[58] Field of Search ..... 404/104, 101, 79, 95, 404/118, 119; 280/781

[56] References Cited

U.S. PATENT DOCUMENTS

| | | | |
|---|---|---|---|
| 3,557,672 | 1/1971 | Shurtz | 404/118 X |
| 3,572,227 | 3/1971 | Poulsen | 404/118 X |
| 3,702,578 | 11/1972 | Davin | 404/118 |
| 3,776,326 | 12/1973 | Davin | 280/781 X |
| 3,907,451 | 9/1975 | Fisher | 404/101 |
| 3,957,384 | 5/1976 | Lamb | 404/118 |
| 3,992,124 | 11/1976 | Schrader | 404/118 |
| 4,129,399 | 12/1978 | Ruge | 404/104 X |
| 4,272,213 | 6/1981 | McGovarin | 404/104 X |

*Primary Examiner*—Nile C. Byers, Jr.

*Attorney, Agent, or Firm*—Mandeville and Schweitzer

[57] ABSTRACT

The disclosure relates to a floating screed type asphalt paver provided with extendable, retractable auxiliary screed units which, in their retracted positions, are mounted in front of the main screed and carry edger plates. By mounting the screed extensions in front of the main screed units, it is possible to retract the extension units without interrupting paving operations. A strike-off plate may be positioned in front of the extension units to limit the presence of paving material between them and/or the extension units may be provided with bevelled inner edges for displacing such material during retraction. Novel arrangements are provided for mounting and adjusting the screed extensions.

17 Claims, 24 Drawing Figures

FIG.14
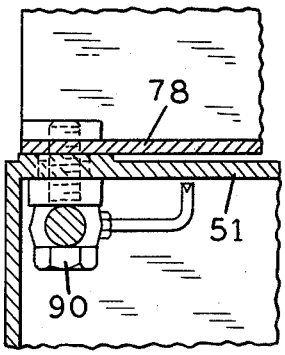
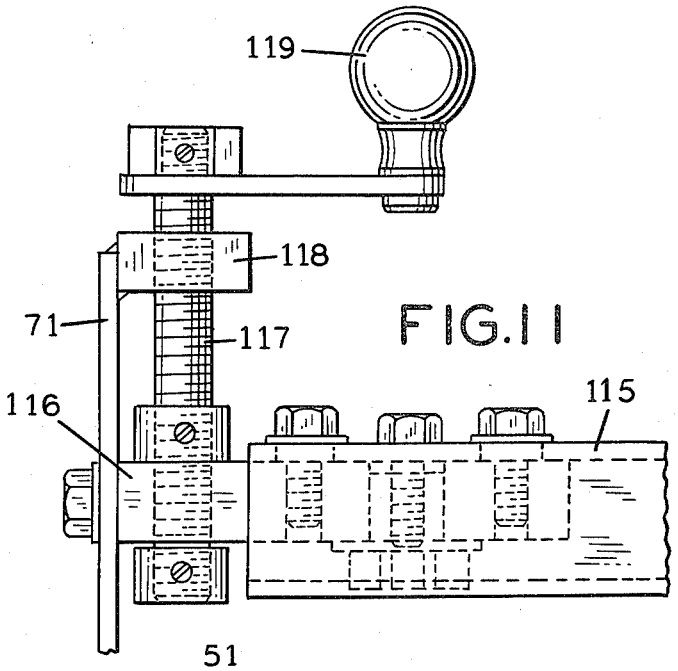
FIG.11
FIG.13
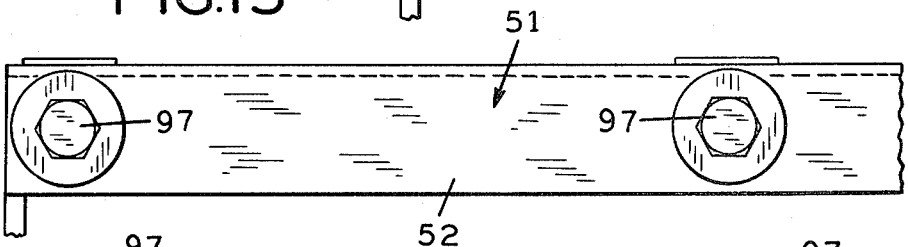
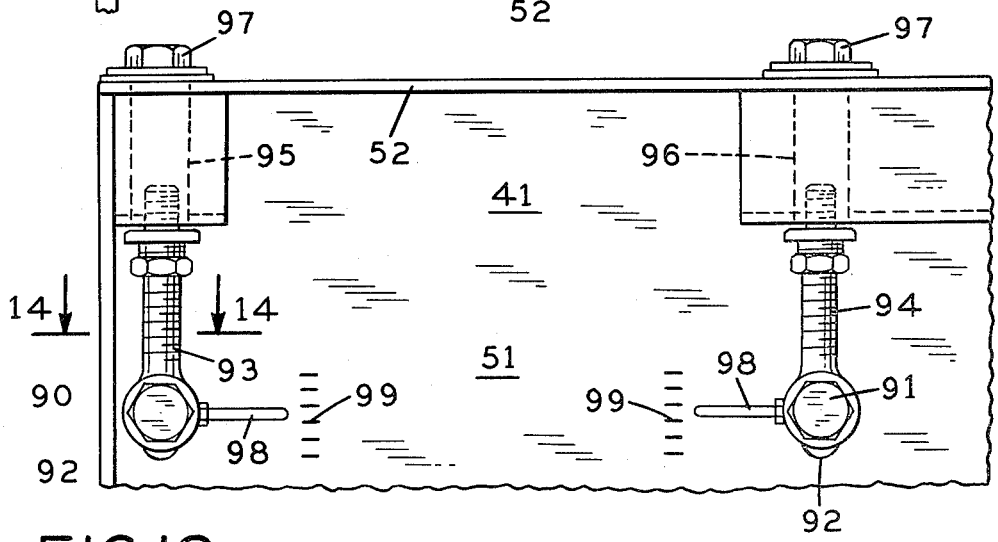
FIG.12
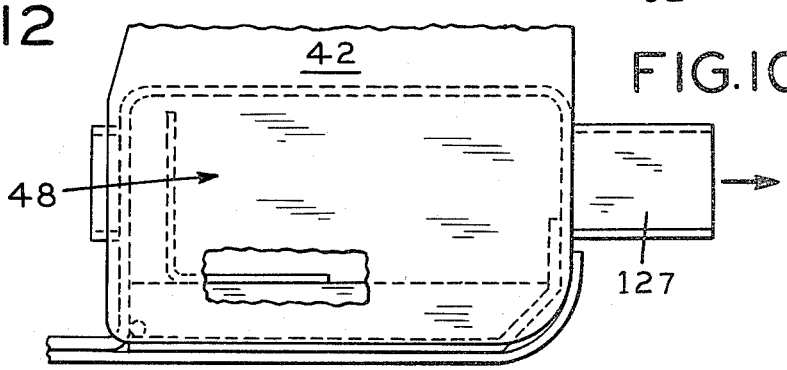
FIG.10

236
235
234
19

227
231
228
226
232
210
225
230
213
235
229
214
249
248
245
245
249
22
22
23
23
24
24
246
237
238
219
218
208
239
220
212
211
213
19

ASPHALT PAVER WITH TELESCOPING SCREED

BACKGROUND AND SUMMARY OF THE INVENTION

The present invention is directed generally to asphalt pavers of the floating screed type as typically reflected in, for example, the Donald R. Davin, et al. U.S. Pat. No. 3,776,326. Such floating screed asphalt pavers typically include a self-propelled paving vehicle provided at its forward end with a hopper of limited capacity for receiving paving material directly from a truck. In typical operation, the paver vehicle engages and pushes the truck forwardly along the highway bed, while the truck progressively discharges its contents of paving material into the hopper. A controllable conveyor arrangement transfers paving material from the hopper to the rear of the paver, where it is discharged onto the road bed, in front of transversely disposed screw auger distributors. The augers spread the material laterally in front of a screed, which functions to lay a "mat" of paving material at a uniform level, and also compresses the paving material and smooths the mat surface. Commonly, the screed is arranged and operated as a so-called floating screed, being connected to the paving vehicle only by elongated tow bars. Relatively accurate control over the mat surface is enabled by controlling the height of the tow points, at each side of the paver, and also by controlling the angle of attack of the screed surface relative to the desired final surface of the paving mat.

A standard asphalt paver is constructed with a screed of standard width. Typically, this may be on the order of eight feet. However, the screeds are constructed to accommodate the mounting at one or both ends of screed extension units enabling substantially wider screeds to be assembled. The Donald R. Davin U.S. Pat. No. 3,702,578 illustrates an advantageous form of such screed extension.

For continuous down-the-road paving operations, it is convenient to assemble the paver screed with the desired number and configuration of extensions, which remain in a permanent configuration throughout a lengthy paving sequence. For many other paving jobs, however, such as driveways, parking lots and the like, the pavement width specifications are not always uniform, and there is need for an ability to vary the width of a screed during the course of a paving operation, without stopping the paver.

Early efforts to provide variability in effective screed width are represented in the Poulsen U.S. Pat. No. 3,572,227 and the Lamb, et al. U.S. Pat. No. 3,957,384. However, both of these devices relate to so-called "strike-off" plates, which are extendable laterally beyond the normal end edges of the paver screed. The strike-off plates, however, function only to scrape or level off the surface of the pavement mat in the extension area and are unable to perform the important functions of a screed, which include "ironing out" the mat surface and also providing a degree of initial compression or compaction of the paving material in advance of rolling. Thus, when equipment such as reflected in the Poulsen and/or Lamb, et al. patents is utilized, the character of the pavement is noticeably different in the area of the strike-off extensions than in the area of the screed proper.

More recently, efforts have been made to construct the floating screed of an asphalt paver with adjustable screed extension units which function not only to level off the material, as in the case of the adjustable strike-off units, but also to smooth out and compact the material, as is the typical function of a paving screed. Representative of these efforts are the Schrader U.S. Pat. No. 3,992,124 and the Ruge U.S. Pat. No. 4,129,399. While these screed extension arrangements represent a significant improvement over the use of adjustable strike-off plates, both arrangements still possess serious functional shortcomings, in that the extension elements of the screed are mounted behind the main screed. The effect of this is that, although outward adjustment of the screed extensions is readily accomplished, full inward retraction of the extensions during paving is not possible. This is because of the fact that a substantial body of the paving material becomes trapped in the space between the ends of the main screed and so-called edger plates, which are mounted at the outer extremities of the screed extensions and extend forward therefrom. When the screen extensions are retracted, paving material becomes trapped in this area and blocks full retraction. In practice, this has necessitated stopping of the paving equipment and a manual shovelling out of the paving material trapped by the retracting extension units. This is of course undesirable, not only from the standpoint of the time lost in stopping the paving equipment, but also in the quality of the paving, inasmuch as the floatation of the screed is affected by the speed of its forward movement. When such forward movement stops, the screed may tend to sink into the paving mat, leaving an irregularity in the finished paving surface.

In accordance with the present invention, a novel and improved form of adjustable paving screed is provided for a floating screed asphalt paver, in which the adjustable screed elements are mounted in front of, rather than behind, the main paver screed. The screed extension units, unlike strike-off extensions, are provided with bottom plates of substantial front-to-back dimension, capable of effectively smoothing and partially compacting the paving material, as well as leveling the material at a desired height. In one advantageous form of the invention, a strike-off plate is provided directly in front of the screed extensions and serves, when the extension units are partially extended, to limit the height of the paving material mass in the area between the extended screed units and the front of the primary screed. Accordingly, when the extension units are retracted during paving operations, the opportunity for excessive accumulation of paving material in the area between the closing extension units is limited. By a slight upward angling of the inner edge extremities of the extension units, whatever minimal accumulation of paving material exists is readily plowed under by the screed bottom surface and spread and flattened by the main screed.

In another advantageous form of the invention, the adjustable extension units are designed for operation without the use of a strike-off plate mounted in front thereof. In this modified form of the invention, the adjustable strike-off extension units are designed to provide upwardly angled regions of the bottom surface, and also inwardly and rearwardly angled front surface portions, along the inner edges. Accordingly, as the extension units are retracted during forward paving motion, accumulated paving material is displaced forwardly and/or plowed under the screed extensions, to permit full closing of the extension units without stopping of the paver.

Certain more specific aspects of the invention involve novel and improved arrangements for mounting of the screed extensions on the front of the main paver screed in a manner which, in general, protects the mounting and guiding means from the hot asphalt ambient, and also simplified and easily operated arrangements for vertical and angular adjustment of the screed extensions in relation to the main screed unit.

The apparatus of the invention also includes a novel and simplified, yet efficient means for utilizing exhaust gases from the main screed heater facility for preheating of the screed extension units. In this respect, it is generally desirable to preheat the screed before commencement of paving, after which it is usually adequate to rely upon the contained heat of the asphalt paving material to maintain a desired temperature equilibrium of the screed. In the apparatus of the present invention, the screed extensions are arranged to receive and utilize exhaust heating gases from a conventional screed heater to effect preliminary heating of the extension units without adding consequential cost to the heating system.

For a more complete understanding of the above and other features and advantages of the invention, reference should be made to the following detailed description of preferred embodiments of the invention and to the accompanying drawings.

DESCRIPTION OF THE DRAWINGS

FIG. 10 is an enlarged, fragmentary end elevational view of the main screed section of the paver.

FIG. 11 is an enlarged, fragmentary view illustrating the means for adjustable mounting of a strike-off plate in front of the screed extension units.

FIG. 12 is a fragmentary elevational section, as viewed generally on line 12—12 of FIG. 9, illustrating the manner of adjustably mounting the screed extension units on the front of the main screed.

FIG. 13 is a fragmentary top elevational view of the mounting arrangement of FIG. 12.

FIG. 14 is a fragmentary cross sectional view as taken generally on line 14—14 of FIG. 12.

DESCRIPTION OF PREFERRED EMBODIMENTS OF THE INVENTION

Figure 1:
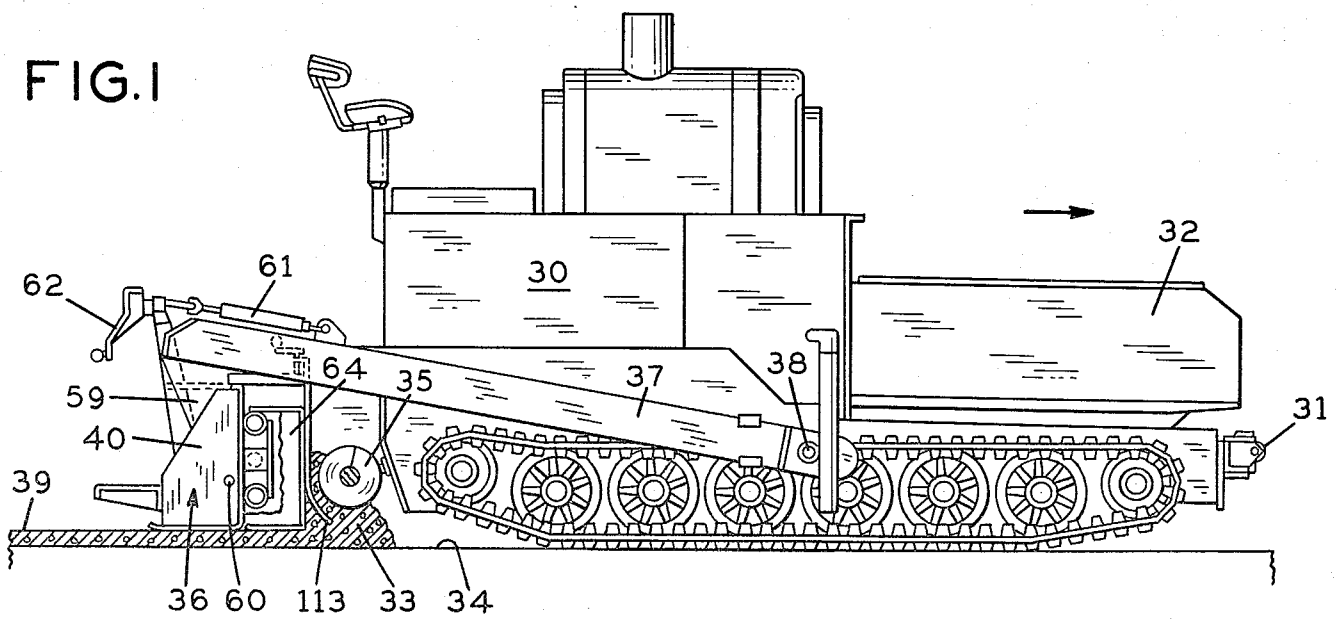
FIG. 1 is a side elevational view of a typical floating screed type asphalt paver apparatus incorporating the screed extension system of the invention.

Referring now to the drawings, and initially to FIGS. 1–16 thereof illustrating a first preferred embodiment, the reference numeral 30 (FIG. 1) illustrates generally a typical form of track-laying, floating screed asphalt paver. In accordance with well known practice, the paver is provided with push rollers 31 at the front, for engaging and pushing forwardly on the wheels of a truck loaded with asphalt paving material. The paving material is arranged to be discharged progressively from the truck into a hopper 32 at the front of the paver. Conveyor means (not shown) controllably transport the paving material to the rear of the paver and deposit it in a mass 33 on the prepared paving bed 34. Screw augers 35 distribute the paving material laterally in front of a screed, generally designated by the numeral 36. The screed is towed behind the paver and connected thereto by a pair of elongated, forwardly extending tow bars 37 connected at their front ends to the chassis of the paver. In accordance with known practice, by controlling the elevation of the tow points 38 and the angle of attack of the bottom surface of the screed 36, a level, uniform paving mat 39 is laid behind the paver as it advances forwardly.

The generalities just described are well known in the paving art. The subject matter of the present invention is directed to specific constructural features of the screed 36, in order to provide a laterally extendable screed arrangement which is significantly superior to previously known adjustable screeds, with particular regard to superior capability of on-the-move adjustment.

In the apparatus of the invention, the screed structure 36 includes a main screed section 40, which may be of more or less conventional construction. Typically, this consists of two screed sections 41, 42 (see FIG. 5) joined by a common sole plate 43 and capable of being disposed at a slight angle with respect to each other, by means of controllable turnbuckle 44, 45 connected by a synchronizing chain 46.

The two main screed sections 41, 42 are, in general, mirror images of each other and only one will be described in detail. Each includes a plurality of gusset plates 47 and a lower box structure 48. The box structure 48 provides a rigid support for the sole plate 43. As will be discussed in somewhat more detail, the box 48 is connected through a triangularly shaped header 49 with a flexible duct 50 leading to a source of heated gas. This arrangement, which per se is well known, provides for the introduction of heating gases into the box during start up operations, to preheat the sole plate 43. A front plate 51 extends upwardly along the entire front face of the screed section, and typically is provided with a rearwardly directed top flange 52. The entire screed structure thus is of a relatively lightweight, but rigid nature.

Along the back of the front wall plate 51 there are pillow blocks 52 journaling a shaft 53 carrying adjustable eccentric weights 54. The shaft is driven by a hydraulic motor 55 through a coupling 56. By control of the speed of rotation of the hydraulic motor 55, and the eccentricity of the weights 54, a desired degree of vibratory action may be imparted to the screed during paving operations.

A suitable platform 57 and grab rails 58 typically are provided to accommodate a screed operator, who may ride on the screed during paving operations.

Figure 16:
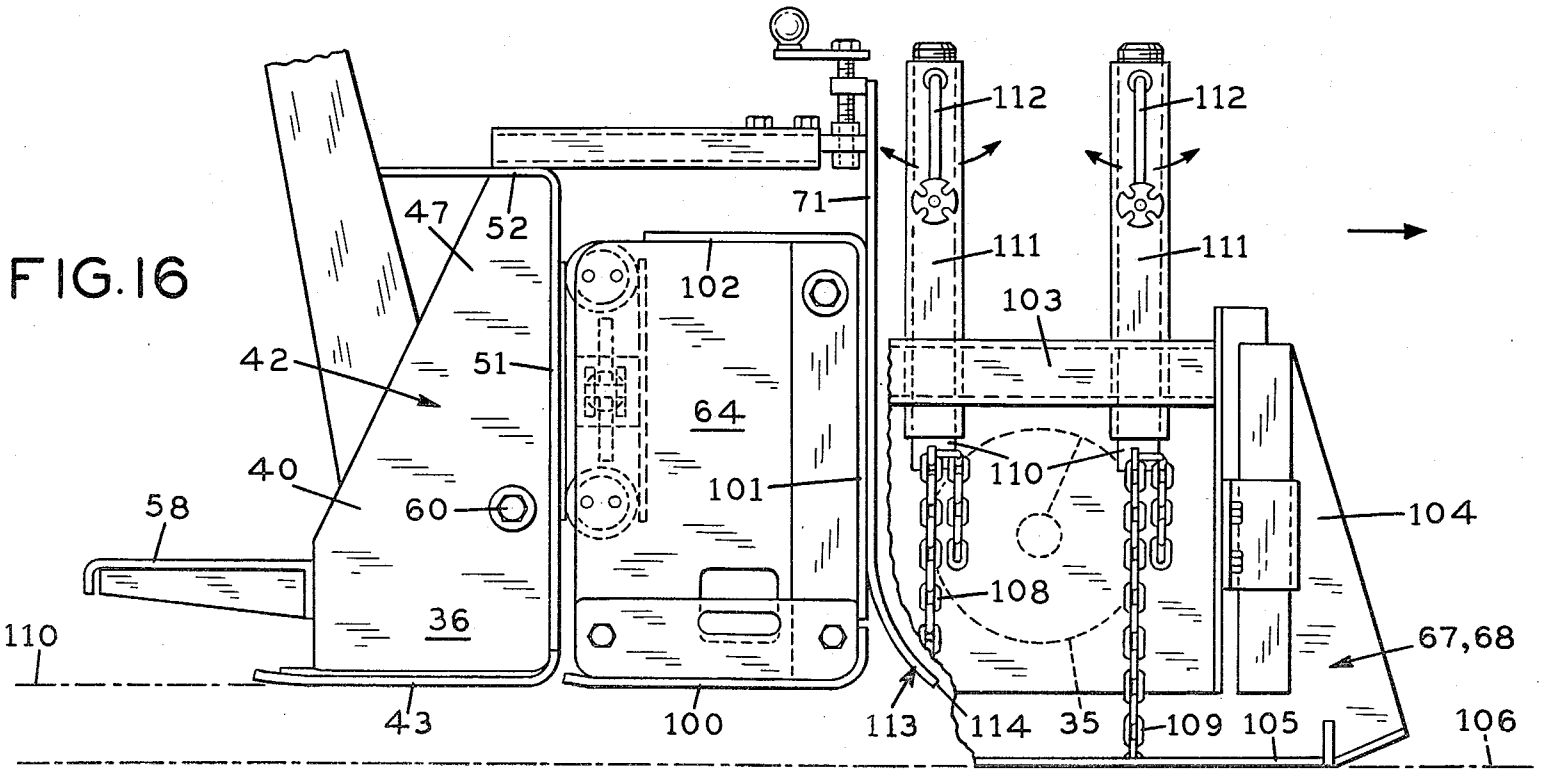
FIG. 16 is an end elevational view of a screed and screed extension assembly illustrating the edger plate and edger plate mounting arrangement.

In the illustrated arrangement, the main screed structure is pivotally connected to tow arms 59, at pivot points 60 (FIG. 16). Angular orientation of the screed relative to the tow bar structure is accomplished by means of turnbuckles 61 associated with hand cranks 62 accessible to the screed operator in a known manner.

The main screed structure described to this point is essentially conventional. The present invention is directed to the provision of significant improvements in the screed arrangement, in the provision of front-mounted screed extensions, which function in the manner of a screed as distinguished from a strike-off and are constructed to accommodate both inward and outward lateral adjustment of the screed extensions during the course of paving operations.

Figure 2:
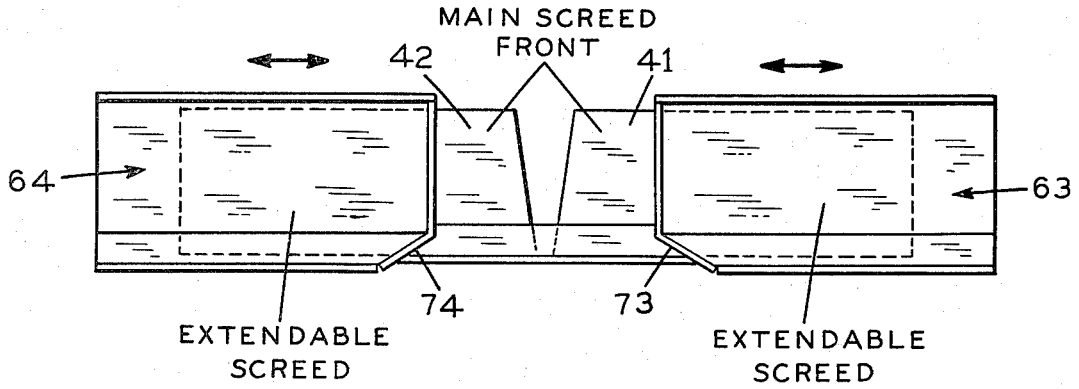
FIGS. 2 and 3 are simplified, schematic front elevation and top plan views illustrating the configuration of screed and screed extension incorporated in the apparatus of the invention.
Figure 3:
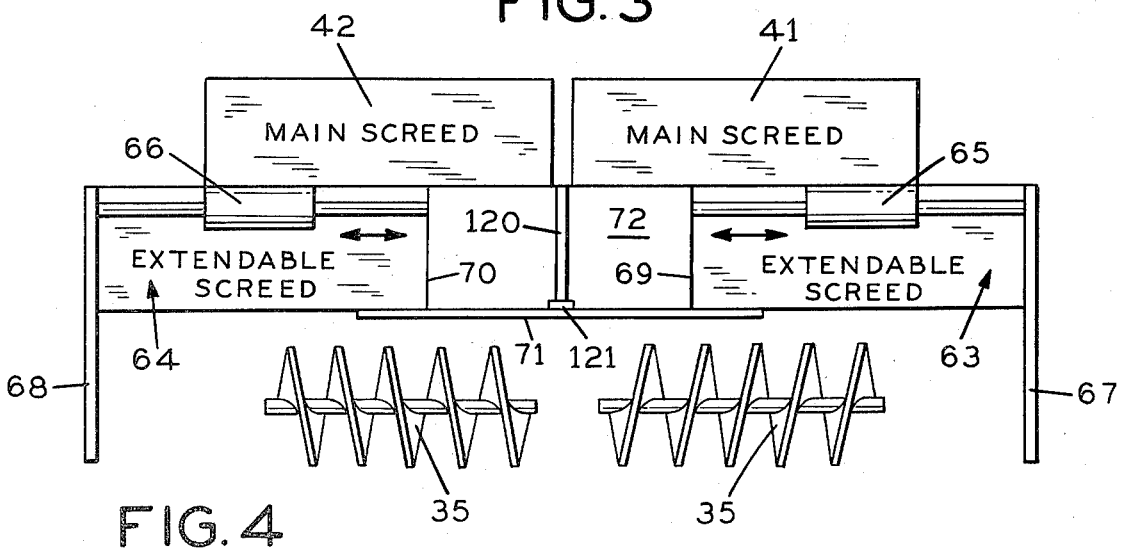

As reflected schematically in FIGS. 2 and 3, for example, the main screed units 41, 42 mount on their forward services movable screed extension units 63, 64, which are movable laterally under the control of fluid cylinders 65, 66, all as will be described in greater detail. At the outboard ends of the screed extensions there are edger plates 67, 68, which are of conventional design and construction and extend forwardly of and below the working surfaces of the screed extensions. Directly in front of the screed extension units are auger sections 35, which serve to distribute asphalt material laterally in front of the screed.

When the screed extensions are fully retracted, the outer ends thereof are more or less even with the ends of the main screed sections, such that the entire assembly acts more or less in the manner of a double screed, one in front of the other.

In order to increase the width of the screed laterally, the hydraulic actuator assemblies 65, 66 are actuated to move one or both of the extension units outwardly for the desired distance.

Heretofore, retraction of screed extension units while the paving equipment is on the move has presented a problem, because of entrapment of paving material between the ends of the main screed, and the edger plates carried by the screed extensions, the extension units having been mounted at the back of the main screed. In the arrangement of the present invention, however, by mounting the extension units on the front of the main screed, there is provided a wide spacing between the edger plates 67, 68 at all times, so that there is no difficulty in retracting the screed extension units inwardly, even though there is paving material contained in the area between the edger plates.

In order to prevent trapping of paving material between the facing ends 69, 70 of the respective screed extensions, provision is made in the first embodiment of the invention for a strike-off plate 71 to be positioned in front of the screed extension units, supported by the respective front surfaces thereof, and serving to level off the paving material in the open region 72 between the extension units. In addition, the lower inner edges of the extension units are bevelled, as at 73, 74 in FIG. 2, such that small amounts of paving material in the area 72 are simply plowed under and levelled off by the screed extension sole plates, as the extensions are closed together. In an alternative form of the invention, illustrated more particularly in FIGS. 17–24, the strike-off plate 71 is eliminated, and the forward inner corners, as well as the bottom inner corners, are bevelled on the screed extension units, to enable any paving material, contained in the open area 72, to be easily displaced and utilized during the closing action of the extension units.

Figure 6:
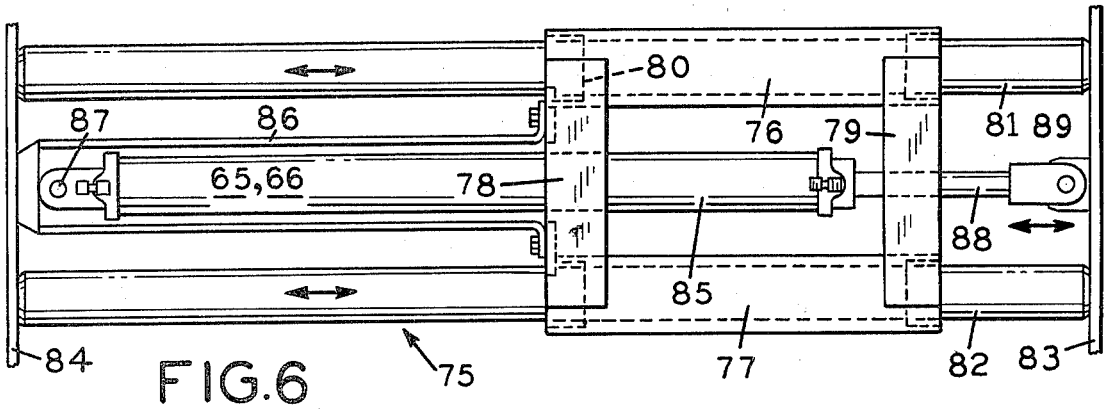
FIG. 6 is an elevational view illustrating the mounting mechanism for the screed extension units.
Figure 7:
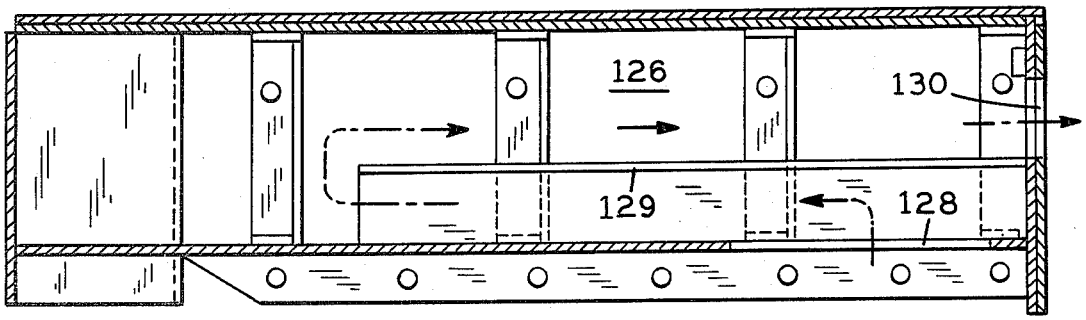
FIG. 7 is a cross sectional view through the lower section of a screed extension unit, illustrating the provision for the flow of exhaust heating gases therethrough for preheating purposes.
Figure 8:
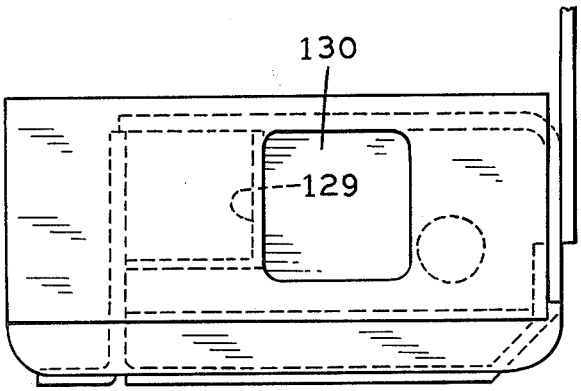
FIG. 8 is a fragmentary end elevational view of the screed extension section of FIG. 7.
Figure 9:
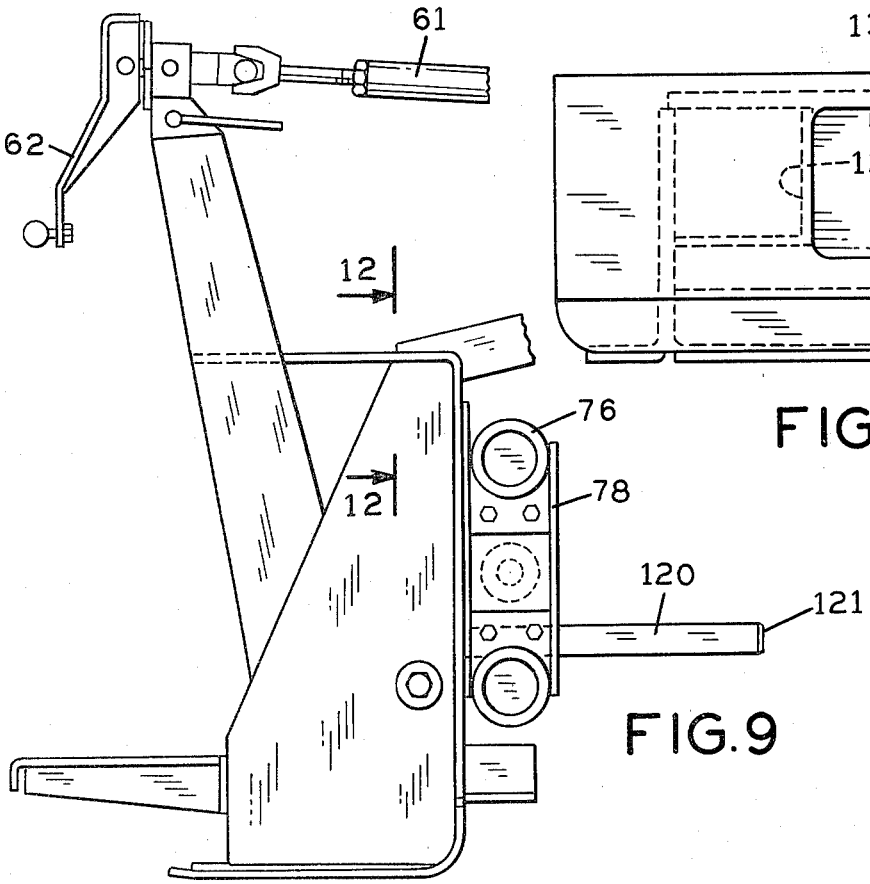
FIG. 9 is an end elevational view of a paver screed, with parts broken away to illustrate the mounting arrangement for the screed extension.

A screed extension support 75, shown in detail in FIG. 6, is mounted on the front face 51 of each main screed 41, 42. The support includes a guide bracket comprising a pair of spaced tubular guides 76, 77 rigidly connected together by brackets 78, 79. The tubular guides 76, 77 are provided with internal slide bearings 80 for the slideable reception of heavy guide rods 81, 82, which are rigidly secured at opposite ends to end walls 83, 84 of the respective screed extension units. The support assembly, which consists of the guide tubes 76, 77 and the brackets 78, 79, is rigidly but adjustably secured to the front face 51 of the associated main screed unit and serves as the sole means of mounting the screed extension to the main screed.

An elongated fluid cylinder 85 is secured to the guide assembly by means of an elongated, U-shaped mounting bracket 86 pivotally connected at 87 to the body of the fluid cylinder. The fluid cylinder rod 88 is in turn connected to the screed extension unit at 89, such that extension of the rod 88 will result in extending movement of the screed extension relative to the main screed unit on which it is mounted.

As will be apparent, the mounting and actuating mechanism for the screed extension units is mounted behind and within the side to side confines of the screed extension unit, when the extension is in a retracted position. When an extension unit is moved outwardly, the body of the cylinder 85 will become progressively exposed in the open space 72, but will not in any event come into steady contact with the hot paving material, because of the strike-off plate 71, which limits the passage of paving material under its lower edge and in general confines it to an area below the cylinder body.

Desirably, the screed extension units 63, 64 are adjustable vertically with respect to the main screed units on which they are mounted, and also adapted to be tilted with respect thereto. Conveniently, this may be accomplish by means of adjustable mountings illustrated in FIGS. 12–14 of the drawing. Thus, in FIG. 12, there are shown a pair of bracket mounting bolts 90, 91, which extend through slotted openings 92 in the front plate 51 of the main screed to secure the guide bracket assembly, as shown in FIG. 6, to the front face of the main screed. These two bolts 90, 91 serve, in the illustrated arrangement, as the sole means of attaching the bracket assembly, and hence as the sole means of mounting the screed extension unit itself. The respective mounting bolts 90, 91 are received in the ends of eye bolts 93, 94, which in turn are received in internally threaded sleeves 95, 96 having bolt-like heads 97 exposed at their upper extremities. The sleeves 95, 96 may be controllably rotated, by application of a wrench to the bolt-like heads 97, causing the eye bolts 93, 94 to be raised or lowered with respect to the sleeves. Indicator elements 98 may be carried by each of the eye bolts and may be associated with calibrations 99 to facilitate operator positioning and orientation of the screed extension unit.

In operation of the equipment, it may well be necessary to have the extension units positioned at a somewhat different level than the main screed unit, to take into account the angle of attack of the entire screed and screed extension assembly. Likewise, it may be desirable to have the screed extensions angled upwardly or downwardly somewhat relative to the main screed, to provide crowning effects or the like.

As shown in FIG. 16, for example, the screed extension units include flat sole plates 100, which have a substantial dimension in the front to back direction, as in the case of the main screed pole plate 43. The extension units may be of box-like configuration, provided with a front plate 101 and top plate or flange 102.

The edger plate assembly 66, 68, shown in FIG. 16, is entirely conventional in basic construction, including a main mounting beam 103, which is bolted or otherwise secured by means (not shown) to the outer end of the screed extension unit. The assembly includes a vertically movable edger plate 104, having a bottom flange 105 adapted to ride in advance of the screed along the prepared road bed 106, below the level of the finished mat 107. The edger plate is secured by a pair of spaced chains 108, 109 carried by vertically adjustable elements 110, carried in vertical guide tubes 111. Conventional hand crank adjustments 112 are provided for controlling the extension of the elements 110 and thus the lower limit of the edger plate. Typically, this is at least slightly below the level of the road bed 106, so that the edger plate simply slides along ahead of the screed extension 63 or 64 and serves to confine the hot paving material at the opposite edges of the mat and serves in effect as a slip form for the side edge of the mat.

As reflected in FIGS. 11 and 16, the front strike-off plate 71 is positioned directly in front of the front faces 101 of the screed extension units and is directly supported thereby. The lower edge of the strike-off plate is curved forwardly at 113, and the lower edge extremity 114 thereof serves as a means of levelling off the paving material directly in front of the screed extensions, over the width of the strike-off plate. Typically, the lower edge 114 may be raised slightly above the level of the extension sole plate 100 so as to accommodate the desired flattening and "ironing" of the mat by the screed sole plate 100.

In the first illustrated form of the invention, there is a separate strike-off plate **71*a*, 71*b* (FIG. 15) for each of the strike-off extensions 63, 64. The strike-off extension 71*b*, for example, is shown in FIG. 15 to be approximately the same length as the screed extension 64**.

At a minimum, the length of the strike-off plate is sufficient that it overlaps slightly in front of the screed extension, when the latter is extended to its maximum. More desirably, the strike-off may extend across the full front face of the screed extension when the latter is retracted. Support for the strike-off is provided by the front face 101 of the screed extension, so that the strike-plate can resist the pressure of the paving material, as the paving machine advances forwardly.

To advance, the strike-off plates are adjustably mounted at the top edge, by means of telescopically adjustable brackets 115, 116, secured by bolts, which can be set to a fixed length after initial assembly. The outer ends 116 of the telescopic brackets carry rotatable threaded shafts 117 engaged with threaded bushings 118 on the strike-off plate and carrying a manipulating crank 119 at their upper ends. The strike-off plates may thus be individually raised and lowered, and also tilted.

Figure 15:
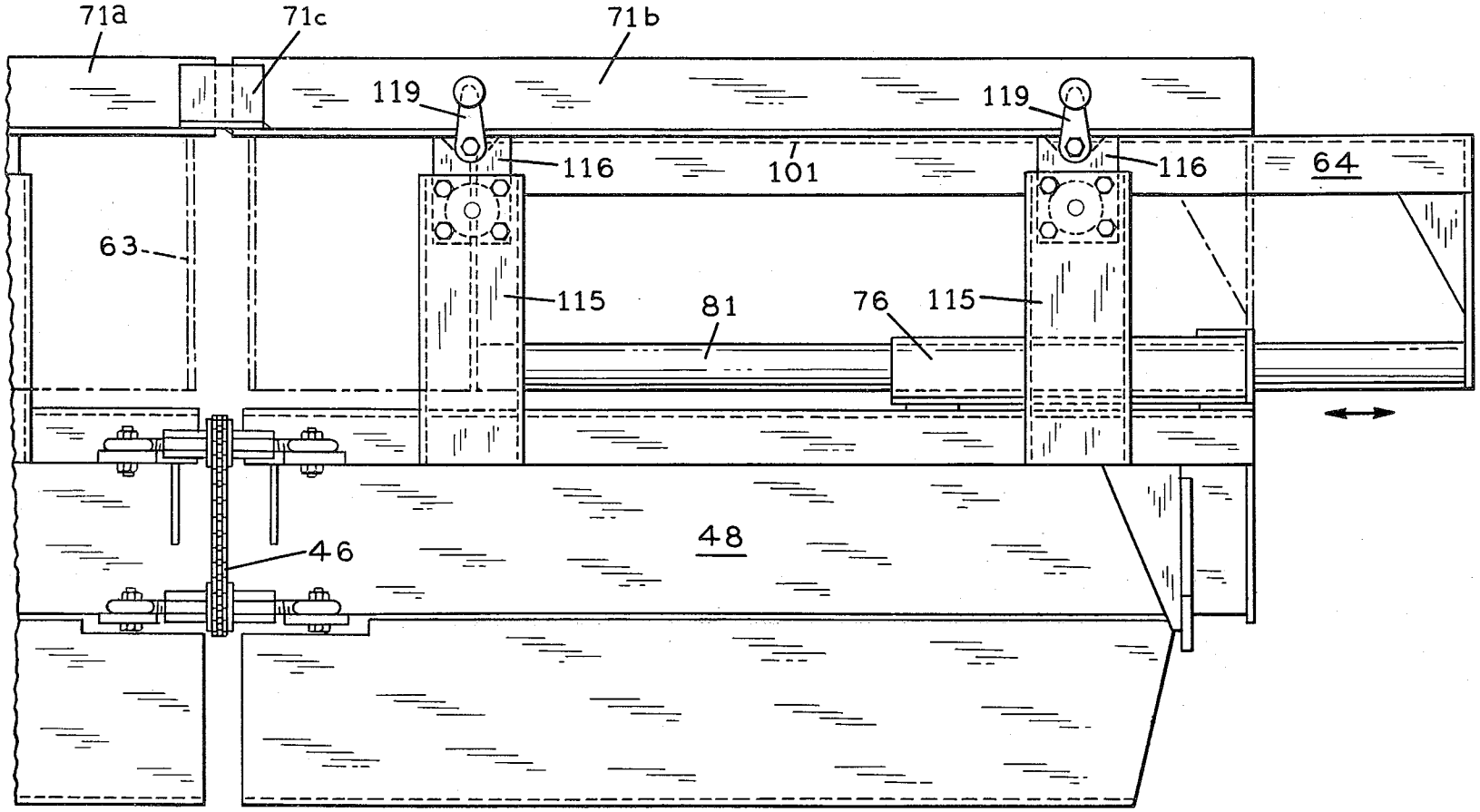
FIG. 15 is a top plan view of the right-hand side of a paver screed section incorporating the screed extension system of the invention.

As reflected best in FIG. 15, the space between adjacent strike-off plates **71*a*, 71*b* is covered by a lapping plate 71*c*, which is welded to the front face of strike-off plate 71*b* and overlaps with the neighboring plate 71*a***.

When the screed extensions are fully closed, the strike-off plates **71*a*, 71*b* are supported across their full front faces. When the extensions are in their outboard positions, however, the inner portions of the strike-off plates lose the support of the screed extensions. In part, this is compensated for by the curved lower configuration of the strike-off plates, which imparts substantial rigidity to the plates. In addition, a central support bracket 120 is mounted at the inner extremity of one of the main screed units 41 or 42 and extends forwardly to the strike-off plates. A short flat plate 121** at the forward end extremity of the support arm, is positioned to engage the strike-off plates and serve as a compression support therefor.

Figure 4:
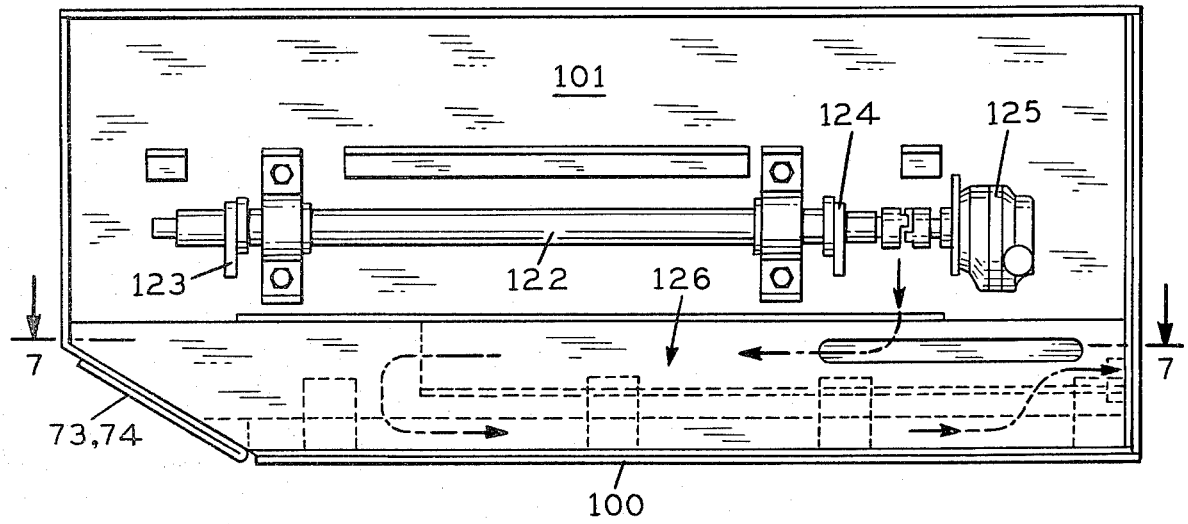
FIG. 4 is a back elevational view of a right-hand screed extension unit according to the invention.
Figure 5:
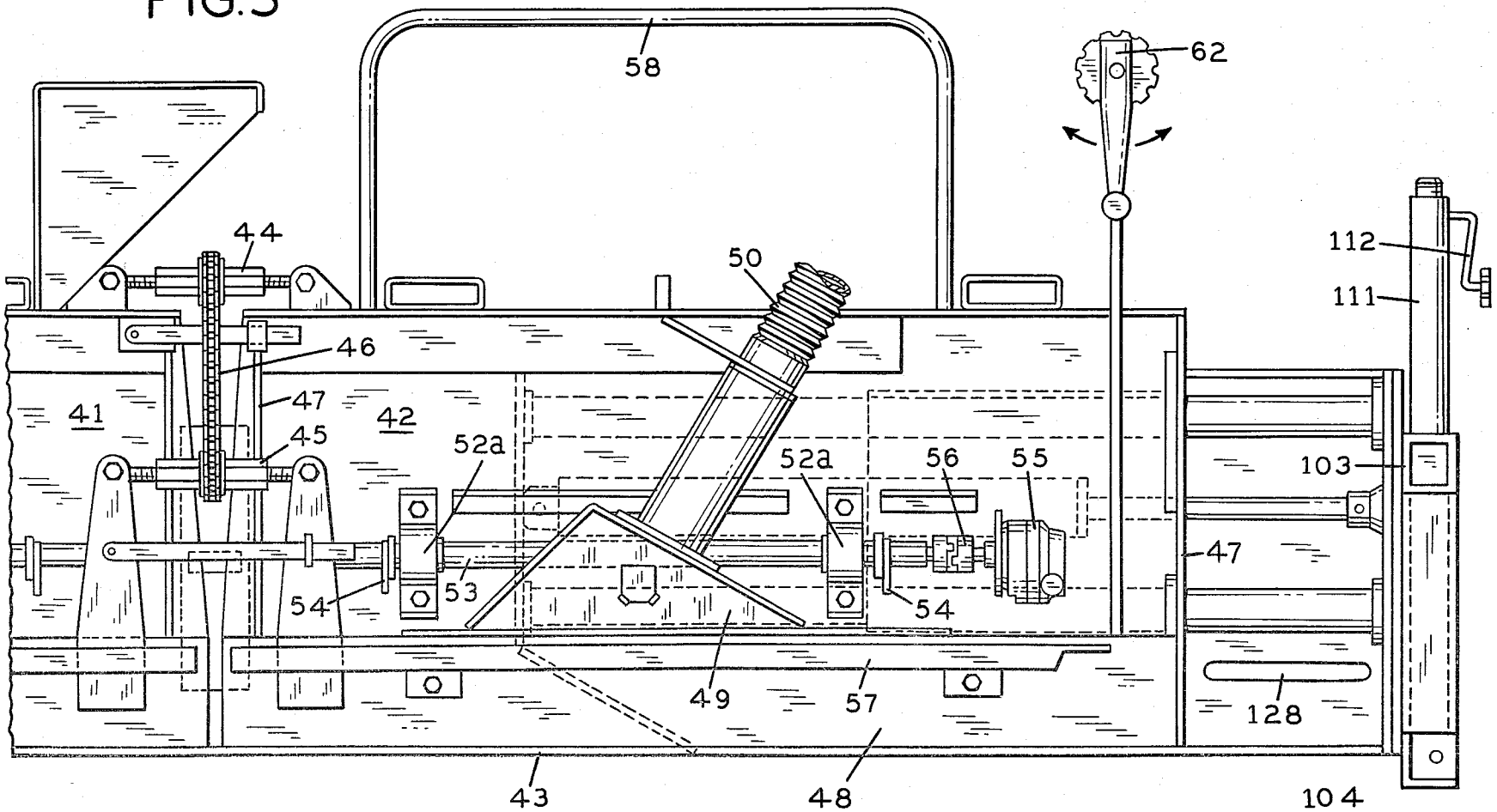
FIG. 5 is an enlarged, back elevational view of the screed section of the paver of FIG. 1, showing a right-hand screed extension partially extended.

As shown in FIG. 4, the front face 101 of the screed extension units may be provided with a shaft 122 carrying eccentric weight assemblies 123, 124 and driven by a suitable hydraulic motor 125, to impart vibratory action to the screed extensions, where desired. As will be understood, the hydraulic motor 125 may be connected to a hydraulic pump by means of flexible lines (not shown) to accommodate the inward and outward movement of the extensions.

The lower portion of the screed extension is a box-like structure 126, not unlike that of the main screed sections, which provides a rigid support for the sole plate 100 and the bevelled inner edge plate 73 or 74. To advantage, the construction of the box-like lower section 126 is such as to accommodate pre-heating of the sole plate of the extension by exhaust gases from the heating of the primary screeds. In this respect, it will be understood that heating of the sole plates primarily is of concern only at the commencement of a paving operation. Once the paving is under way, both the main screed sections and the screed extensions become thoroughly heated from the hot asphalt paving material as received from the trucks, so that continuous heating is unnecessary.

In FIG. 10, there is shown a fragmentary illustration of a section of the main screed, with its box-like lower portion 48. Hot gases are introduced into the interior of the box-like section 48 and are passed therethrough by suitable baffling (conventional and not shown) to effect heating of the sole plate. According to the invention, however, the heated gases are not exhausted to the atmosphere at this point, but are directed through a forwardly projecting transfer tube 127, discharging adjacent the rear edge of the box structure 126 of the screed extension. That box structure is provided with an elongated opening 128, shown in FIGS. 5 and 7. When the screed extension is in its fully retracted position, as just prior to the start of a paving operation, the slotted opening 128 is aligned opposite the discharge of the transfer tube 127, and the hot gases leaving the main screed are transferred into the bottom of the screed extension. A longitudinal baffle arrangement 129 guides the gases first in one direction and then in the other through the screed extension, causing the gases ultimately to be exhausted through an end opening 130. When the extension units are displaced outwardly, the transfer tube 127 and gas inlet 128 are of course out of alignment, but at this stage of activity, it is usually unnecessary to provide an external source of heat for the screed units.

Figure 17:
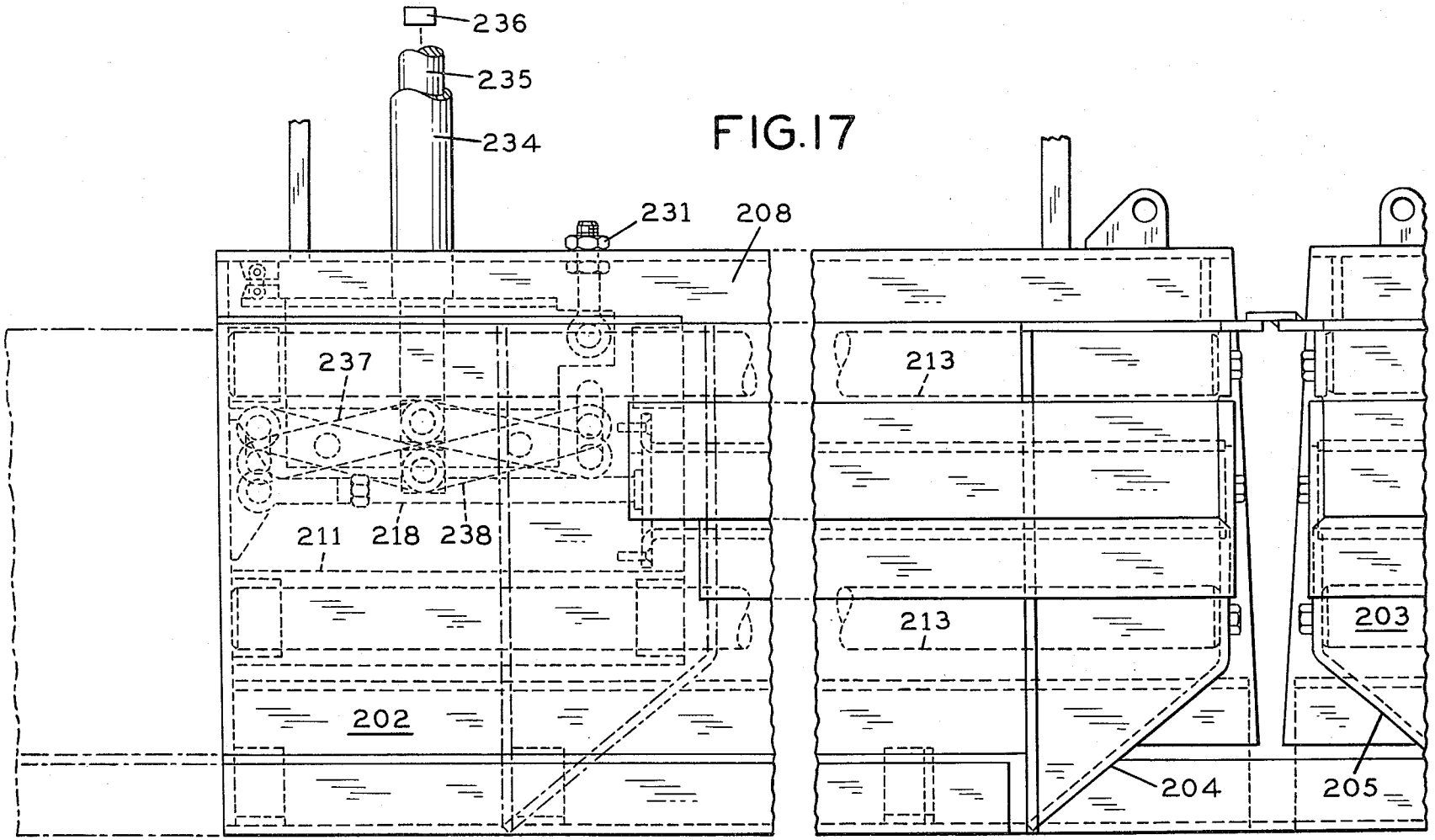
FIG. 17 is a front elevational view of a paver screed incorporating a modified form of screed extension unit designed for operation without the use of a front-mounted strike-off plate.

In the form of the invention shown in FIGS. 17–24, there is a modified form of front-mounted screed extension arrangement, in which the inner front edges 200, 201 of screed extension units 202, 203 (see FIG. 20) are bevelled, as are the lower inner edges 204, 205 (see FIG. 17). In the modified form of the equipment, the strike-off plate 71 of the first described form may be eliminated, and the "plowing" action of the bevelled surfaces is relied upon to effectively displace and roll under any paving material which is between the opposed end faces of the screed extension units as the same are being retracted during paving operations.

Figure 18:
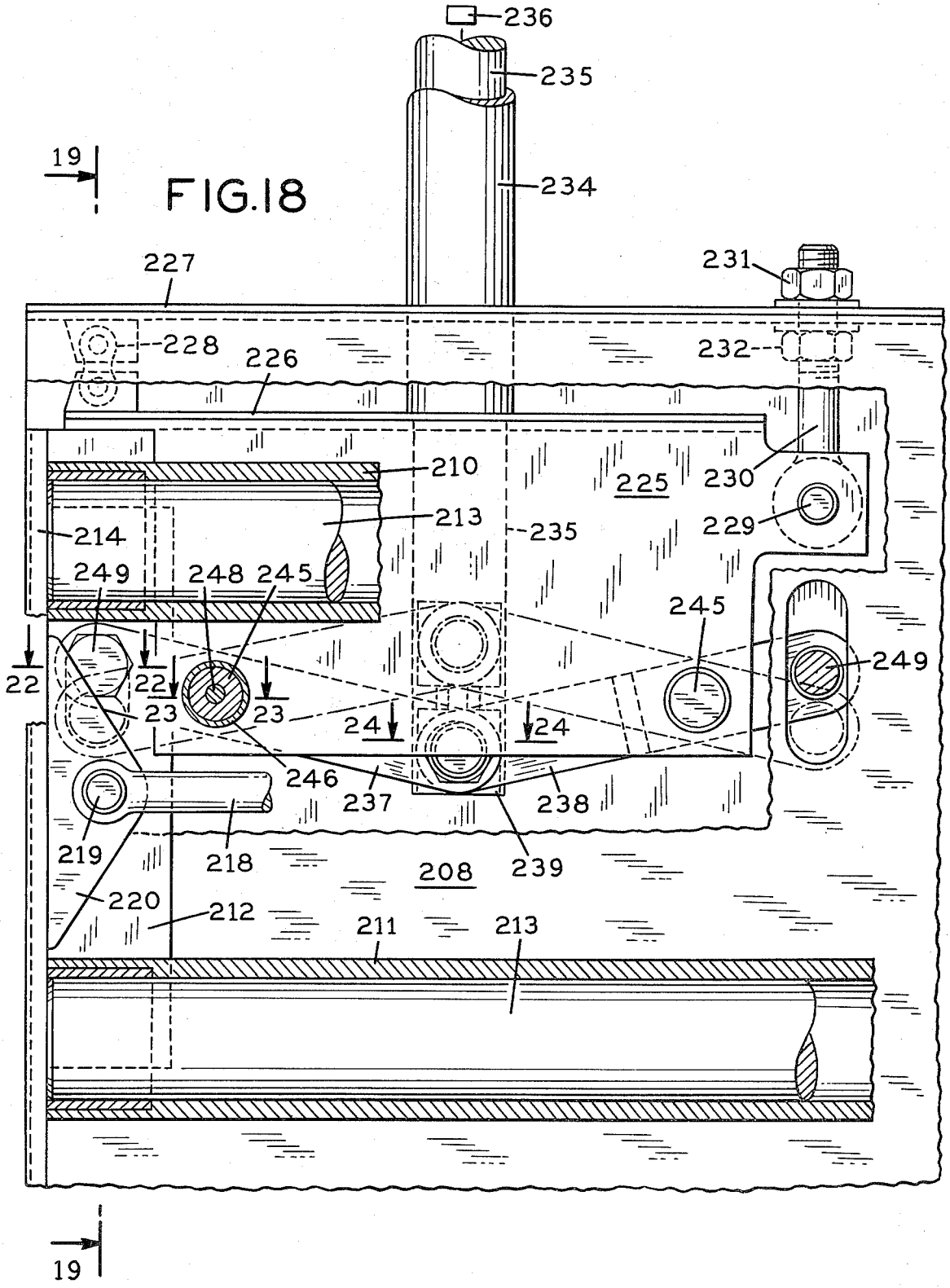
FIG. 18 is an enlarged, fragmentary view, with parts broken away, illustrating the adjustable mounting arrangements for the modified screed extension unit.
Figure 19:
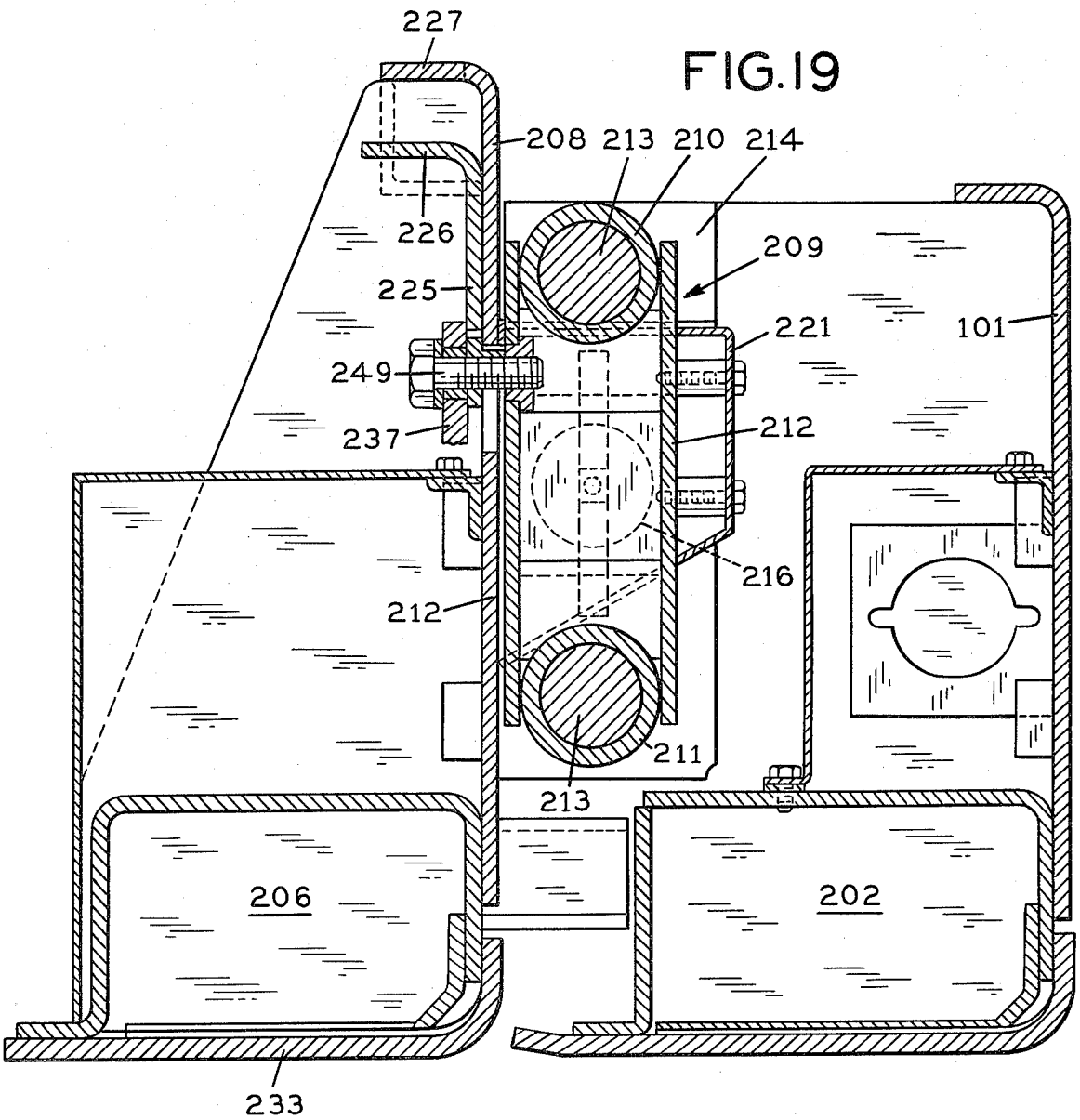
FIG. 19 is a cross sectional view taken generally along line 19—19 of FIG. 18.
Figure 20:
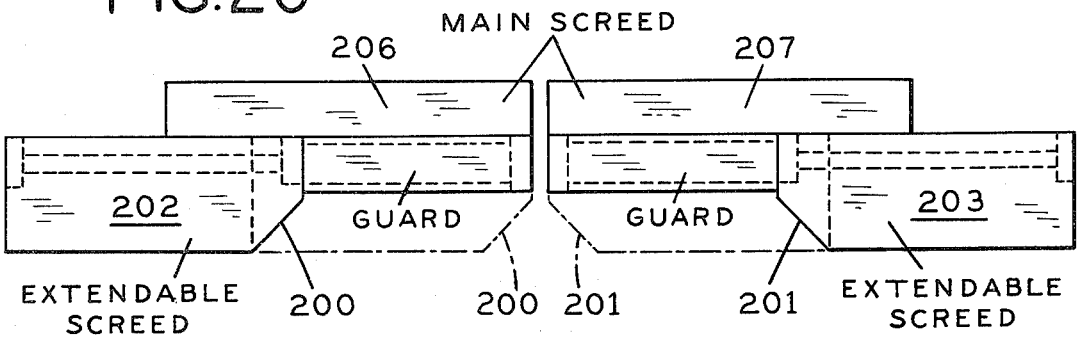
FIG. 20 is a simplified, schematic top plan illustration of the modified form of screed and screed extension assembly.
Figure 21:
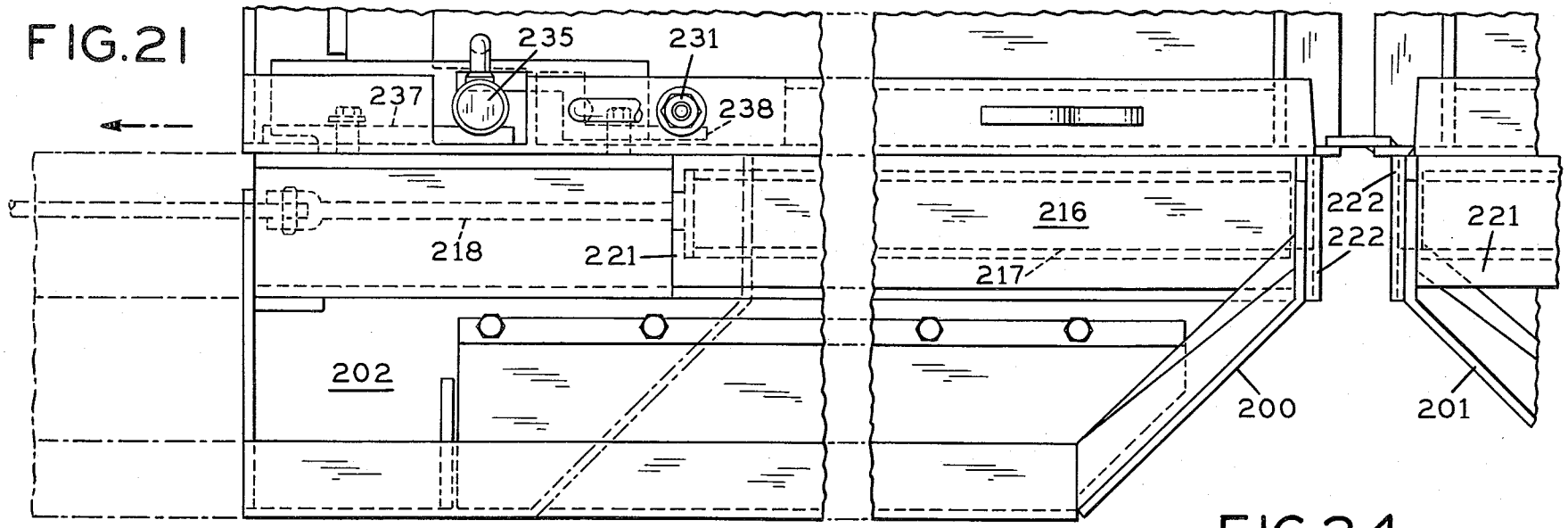
FIG. 21 is a fragmentary top plan view of a right-hand screed extension unit of the modified form.
Figure 24:
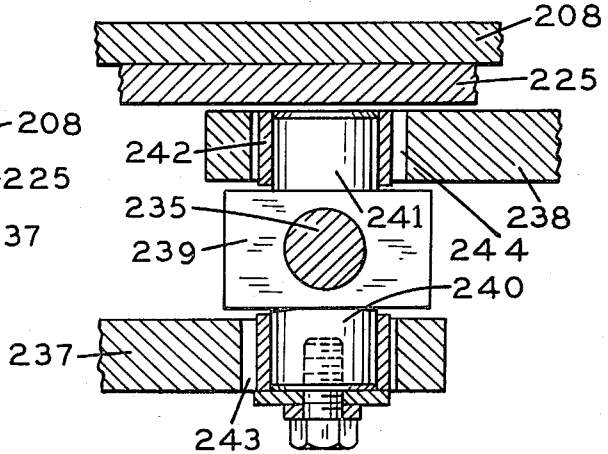
FIGS. 22–24 are enlarged, fragmentary cross sectional views as taken generally along lines 21—21, 22—22 and 23—23 respectively of FIG. 18.
Figure 23:
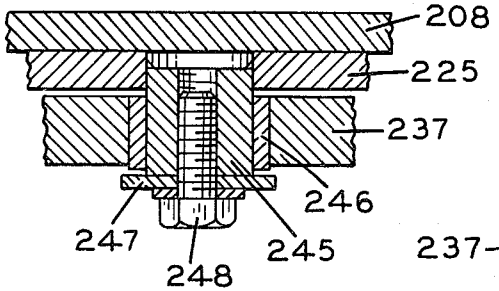

As reflected in FIG. 19, the screed extension unit 202 is mounted on the front plate 208 of the main screed unit 206 by a mounting assembly 209, which is basically similar to the assembly 75 shown in FIG. 6. This assembly includes spaced guide sleeves 210, 211 rigidly joined by pairs of brackets 212 and serve to support heavy slide rods 213 secured at their opposite ends to end plates 214 of the box-like screed extension units. A fluid actuator unit 216 is mounted between the guide sleeves 210, 211. The cylinder body 217 is secured to the support assembly 209, and the cylinder rod 218 is secured by a pin 219 and bracket 220 to the extension end wall 214. This is, in general, similar to the arrangement shown in FIG. 6, with respect to the first described embodiment. With respect to the embodiment of FIGS. 17–24, however, since the strike-off plate 71 is not utilized, a sheet metal housing 221 is provided to cover that portion of the cylinder housing 217 which is exposed when the screed extension unit is in its position of maximum outboard extension. The housing serves to prevent direct contact between the fluid-containing cylinder and the hot asphalt material being advanced and displaced by the screed assembly. An appropriate opening is provided in the inner end wall structure 222 of the respective screed extensions, to accommodate the housings 221, when the extension units are displaced outwardly.

In the form of the invention shown in FIGS. 17–24, a simplified form of mechanism is provided for effecting the desired vertical adjustments of the screed extension units relative to the respective main screed units. To this end, separate facilities are provided for elevating and tilting the extension units. As shown in FIGS. 17–19, a positioning bracket 225 is mounted on the backside of the main screed front wall 208. The bracket includes an upper, rearwardly directed flange 226, which is pivotally connected at its outboard end to the upper flange 227 of the main screed, by means of a pivot connecting link 228. At its inboard end, the positioning bracket is connected by a pin 229 to an eye bolt 230, which extends through the main screed flange 227 and carries an adjusting nut 231 on one side and a locking nut 232 on the other. By appropriate adjustment of the nuts 231, 232 the positioning bracket 225 may, within the limits of its adjustment, be pivoted about the link 228 to be disposed at an angle with respect to the sole plate 233 of the main screed. As will become apparent, the angular positioning of the plate 25 controls the angularity of the screed extension itself with respect to the main screed.

A generally vertical guide tube 234 is welded or otherwise secured to the upper flange of the positioning bracket and slideably positions an adjusting rod 235. The positioning rod 235 is connected to an appropriate positioning actuator, schematically indicated at 236 in FIG. 18, which may be a conventional hand crank and screw arrangement, or more desirably is a motorized screw that can be remote controlled by the screed operator. The arrangement is such that the adjustment rod 235 is controllably adjustable linearly within the guide tube 234.

At its lower end, the adjusting rod 235 is pivotally connected to a pair of scissors levers 237, 238. Thus, as shown in more detail in FIG. 24, the adjusting rod 235 mounts a pivot block 239 at its lower end, from which pivot pins 240, 241 extend. Sleeve bearings 242 surround the pins, and the sleeve bearings are received in elongated openings 243, 244, in the respective scissors levers.

Intermediate their ends, the scissors levers 237, 238 are pivotally secured by pins 245 to the positioning bracket 225 such that, upon controlled vertical adjustment of the adjusting rod 235, the scissors levers 237, 238 will pivot around the pins 245. As reflected more particularly in FIG. 23, the pivot pins 245 are welded or otherwise secured to the positioning bracket 225 and extend rearwardly a short distance, passing through bushings 246 in the respective scissors levers 237, 238. A flat washer 247 and cap screw 248 serve to retain the scissors levers in position. At their outboard ends, the respective scissors levers are connected through pins 249 to the respective bracket elements 212 of the screed support assembly 209.

Figure 22:
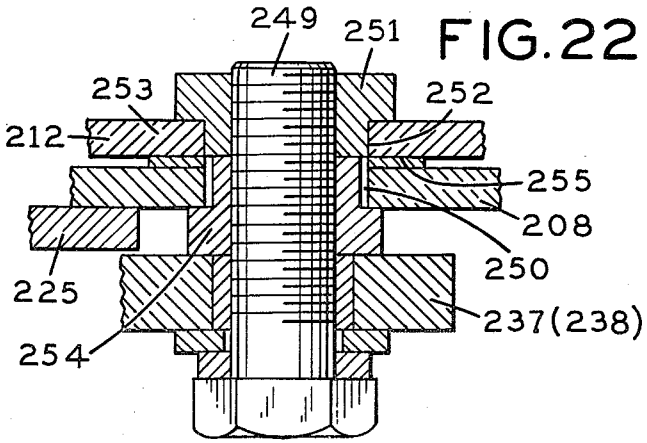

With reference particularly to FIG. 22, the pivot pin 249 is in the form of a bolt, which passes through the scissors levers 237 (or 238), through a vertical slot 250 in the main screed front wall, and is secured in a threaded bushing 251 anchored in the bracket 212, which forms part of the support assembly 209 for the screed extension (see FIG. 19). The bushing 251 is received in an opening 252 in the support bracket 212 and is positioned therein by a shoulder 253. A second shouldered bushing 254 is slideably received over the connecting bolt 249 and extends through the vertically slotted opening 250 in the screed front plate 208. The bushing 254 serves as a spacer, maintaining a desired spacing between the scissors levers 237, 238, the screed plate 208, and the support bracket 212. In addition, a thin spacing washer 255 is inserted between the plate 208 and bracket 212.

As will be apparent in FIGS. 18 and 19, when the adjusting rod 235 is either extended or retracted, the scissors levers 237, 238 will be caused to rotate about pivot points 245, to either raise or lower the outer end connecting bolts 249. This correspondingly raises or lowers the support bracket 209 at both ends, and thus raises or lowers the screed extension unit 202, 203 relative to the associated main screed unit, without changing the angular orientation of the screed extension.

In either of its described forms, the screed apparatus of the invention is importantly advantageous over equipment heretofore known in the art. Thus, by mounting the screed extension units in front of the main screed, rather than behind as is known in the art, it becomes possible to effect on-the-move adjustment of the screed extensions, inward as well as outward. Whereas heretofore it has been typically necessary to stop the paving equipment and literally shovel out paving material trapped between the extension-mounted edger plates and the main screed, the mounting of the screed extension on the front of the main screed obviates that necessity. Similarly, the accumulation of excessive paving material between the opposed inner ends of the respective screed extension units is prevented, so that the units may be brought back to their fully retracted positions as paving continues. In the first illustrated form of the invention, represented in FIGS. 1–16 of the drawings, this is accomplished by providing a strike-off plate, suspended by its upper edge and supported directly against the front faces of the screed extension units, to limit the amount of paving material permitted to enter the space between the screed extensions, when the latter are in outboard positions. In conjunction with this, the lower inboard corner areas of the screed extension units are bevelled downward and outward, so as to tend to plow under the screed sole plate whatever accumulations of paving material exist between the closing extension units.

In the alternate form of screed arrangement illustrated in FIGS. 17–24 of the drawings, the screed extension units are also bevelled along their forwardly facing inside corner areas, as well as along the bottom inside corners, for efficient displacement of paving material present in the area between the retracting screed extensions units. In the alternative form of the screed structure, the strike-off plate may be omitted if desired.

An advantageous form of screed extension adjusting mechanism is also shown in FIGS. 17–24, in which a single adjustment is provided for tilt control, and a second single adjustment means is provided for raising and lowering of the extension units relative to the main screed units on which they are carried.

The arrangement of the invention greatly extends the utility and adaptability of the floating screed type asphalt paver units for off-the-road paving jobs in particular. Thus, whereas down-the-road highway paving may continue mile after mile without the need for screed width adjustment, there are extensive varieties of paving requirements in which rapid, on-the-move adjustment is highly desirable. These include such diverse paving requirements as parking lots, driveways, residential streets, etc.

The system of the invention, providing an operative arrangement for a front mounted screed extension, is significantly superior to known arrangement in which, alternatively, the screed extensions were mounted at the rear of the main screed or a simple extendable strike-off plate was provided at the front of the main screed. The use of a strike-plate, rather than a screed, has serious limitations as to the character of the paving quality achieved, because of the manner in which the strike-off plate functions. Thus, the strike-plate merely scrapes off the excess material at a defined level, leaving a somewhat loose, rough surface which, if it is packed down at all, must be done by a subsequent rolling operation. A screed extension, on the other hand, applies a broad, flat sole plate to the surface of the paving mat in the extension area. Not only does this flatten and smooth the mat surface, but the weight of the entire screed assembly is proportionately supported by the screed extension elements, so that a degree of compacting and pressing of the pavement mat is accomplished, as in the case of the main screed.

While distinctly superior paving results are achieved with the use of extendable screed units, as distinguished from strike-off extensions, the screed assembly of the invention does not suffer from the important disadvantages of known extendable screed arrangements which, in general, have required stoppage of the paving equipment in order to accommodate inward retraction of the extendable units. Stoppage of floating screed asphalt paving equipment is, of course, highly undesirable, because the levitated screed loses the benefit of the effect of the angle of attack of the screed sole plate moving forwardly over the pavement mat. When this component of lift is lost, as when the screed stops its forward motion, the screed can tend to sink into the pavement mat somewhat, leaving a slight but undesirable irregularity in the pavement surface.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A screed assembly for a floating screed asphalt paving machine, which comprises (a) first and second main screed units, each including a front plate and a sole plate, (b) screed extension units for each of said main screed units, each including a front plate and a sole plate, (c) means for mounting said screed extension units in front of said main screed units, with the front plates of said extension units being positioned a substantial distance forwardly of the main screed units and the sole plates of said screed extension units extending rearwardly substantially to the front plates of said main screed units, (d) said mounting means including, for each said extension unit, a pair of spaced guide rods mounted on said screed extension units and extending laterally substantially from one end to the other thereof, and a pair of guide sleeves slideably engaging said guide rods, (e) said guide sleeves forming part of a support bracket assembly mounted at the front of a main screed unit, (f) means for effecting vertical adjustment of said support bracket assembly relative to the main screed or screed extension unit, whereby to effect vertical adjustment of said screed extension unit with respect to the main screed unit, (g) controllable positioning means for effecting controlled lateral extending and retracting movements of the screed extensions, and (h) clearing means for preventing the accumulation of excessive amounts of paving materials between said screed extensions during retracting movements while paving, such that extending or retracting adjustments of said screed extension units may be effected at any time.

2. A screed assembly according to claim 1, further characterized by said clearing means comprising (a) a strike-off plate means positioned in front of said screed extension units and supported from behind by the respective front plates thereof, (b) said screed extension units being movable laterally independently of said strike-off plate means.

3. A screed assembly according to claim 2, further characterized by
(a) strike-off support arms mounted on said main screed units and extending forwardly to the front of said screed extension units, and
(b) strike-off adjustment means connecting said support arms and said strike-off plate means for effecting vertical adjustment thereof.

4. A screed assembly according to claim 3, further characterized by
(a) said strike-off plate means including a separate strike-off plate mounted by each of said main screed units,
(b) one of said strike-off plates at least partially overlapping the other.

5. A screed assembly according to claim 4, further characterized by
(a) a strike-off auxiliary back support extending forward from one of said main screed units and engaging the rear surface of said other strike-off plate to provide enhanced support when said screed extension units are laterally extended.

6. A screed assembly according to claim 1, further characterized by
(a) said clearing means comprising upwardly and inwardly bevelled bottom surface portions of said screed extensions joining the sole plates thereof at the inner ends of said screed extensions whereby at least limited quantities of paving material are directed underneath the screed extensions during retraction thereof while paving.

7. A screed assembly according to claim 6, further characterized by
(a) said assembly including strike-off plate means in accordance with claim 2.

8. A screed assembly according to claim 6, further characterized by
(a) said clearing means further including rearwardly and inwardly bevelled front surface portions of said screed extensions joining the front plates thereof at the inner ends of said screed extensions.

9. A screed assembly according to claim 1, further characterized by said means for effecting vertical adjustment of said support brackets comprising
(a) a positioning plate mounted on the back side of the main screed front plate,
(b) means for adjusting the angular orientation of said positioning plate relative to said main screed,
(c) connecting means extending through said main screed front plate and securing said support bracket assembly to said positioning plate, and
(d) means for moving said support bracket assembly in a generally vertical direction relative to said positioning plate.

10. A screed assembly according to claim 9, further characterized by the means for moving said support bracket assembly comprising
(a) a pair of support pins engaging said support bracket assembly and extending through said main screed front plate,
(b) a pair of scissors levers pivoted on said positioning plate and engaging said support pins, and
(c) actuator means mounted on said positioning plate and engaging said scissors levers,
(d) said actuator means being adapted for controlled actuation to effect controlled adjustment of said support bracket assembly in a generally vertical direction.

11. A screed assembly according to claim 10, further characterized by
(a) said actuator means including a generally vertically disposed linear actuator mounted on said positioning plate,
(b) said scissors levers being connected at their adjacent ends to said linear actuator,
(c) said scissors levers being pivotally connected intermediate their ends to said positioning plate, and
(d) said scissors levers being connected at their far ends to said support bracket assembly.

12. A screed assembly for a floating screed asphalt paving machine, which comprises
(a) first and second main screed units, each including a front plate and a sole plate,
(b) screed extension units for each of said main screed units, each including a front plate and a sole plate,
(c) means for mounting said screed extension units in front of said main screed units, with the front plates of said extension units being positioned a substantial distance forwardly of the main screed units and the sole plates of said screed extension units extending rearwardly substantially to the front plates of said main screed units,
(d) clearing means for preventing the accumulation of excessive amounts of paving material between said screed extensions during retracting movements while paving, such that extending or retracting adjustments of said screed extension may be effected during paving,
(e) means in the bottom area of said main screed units forming a heating chamber,
(f) means to supply hot gases to said heating chamber,
(g) gas outlet means for said heating chamber,
(h) a secondary heating chamber in each of said screed extension units,
(i) each said secondary heating chamber having an inlet aligned generally with said gas outlet means in certain predetermined positions of alignment of said main screed units and said screed extension units.

13. A screed assembly for a floating screed asphalt paving machine, which comprises
(a) first and second main screed units, each including a front plate and a sole plate,
(b) screed extension units for each of said main screed units, each including a front plate and a sole plate,
(c) means for mounting said screed extension units in front of said main screed units, with the front plates of said extension units being positioned a substantial distance forwardly of the main screed units and the sole plates of said screed extension units extending rearwardly substantially to the front plates of said main screed units, and
(d) edger plates mounted on said screed extension units and extending forward therefrom and below the level of the sole plates thereof.

14. A screed assembly according to claim 13, further characterized by
(a) strike-off plate means mounted directly in front of said screed extension units, when retracted, and serving to limit the presence of paving material between said extension units when said units are in extended positions.

15. A screed assembly according to claim 13 and/or 14, further characterized by (a) said screed extensions having upwardly and inwardly bevelled bottom surface portions at the inside edge extremities thereof.

16. A screed assembly according to claim 13, further characterized by (a) said screed extension having upwardly and rearwardly bevelled surface portions at their inner end extremities joining the respective sole plates and front plates thereof.

17. A screed assembly according to claim 16, further characterized by (a) an hydraulic cylinder mounted on each of said main screed units and connected to the respective screed extension unit, (b) said hydraulic cylinders each having a cylinder body extending toward the center of the screed assembly, and (c) housing means covering those portions of the cylinder bodies that are exposed to paving material upon lateral extension of said screed extension units.

* * * * *